US006629339B2

(12) United States Patent
Pohl et al.

(10) Patent No.: US 6,629,339 B2
(45) Date of Patent: Oct. 7, 2003

(54) REFRIGERATOR HANDLE MOUNTING ARRANGEMENT

(75) Inventors: Douglas A. Pohl, Davenport, LA (US); William H. Lotz, Galesburg, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/984,770

(22) Filed: Oct. 31, 2001

(65) Prior Publication Data

US 2003/0079313 A1 May 1, 2003

(51) Int. Cl.[7] ..... A45C 13/26
(52) U.S. Cl. ..... 16/436; 16/DIG. 24
(58) Field of Search ..... 16/436, 412, 413, 16/DIG. 24, DIG. 25, DIG. 19, 422, 424; 248/220.21, 222.13, 224.51, 224.61, 316.2, 316.8

(56) References Cited

U.S. PATENT DOCUMENTS

| | | | | |
|---|---|---|---|---|
| 2,175,632 A | | 10/1939 | Maga | |
| 3,995,349 A | | 12/1976 | Roberts et al. | |
| 4,087,141 A | * | 5/1978 | Roberts | 312/348.6 |
| 4,745,656 A | | 5/1988 | Revlett | |
| 4,922,576 A | | 5/1990 | Weidner et al. | |
| 5,193,244 A | | 3/1993 | Meyers | |
| 5,303,445 A | | 4/1994 | Meyers | |
| 5,402,553 A | | 4/1995 | Goetz et al. | |
| 5,493,756 A | | 2/1996 | Shanok et al. | |
| 5,797,164 A | * | 8/1998 | Donaghy | 16/412 |
| 6,019,447 A | | 2/2000 | Jackovin | |

* cited by examiner

*Primary Examiner*—Anthony Knight
*Assistant Examiner*—Doug Hutton
(74) *Attorney, Agent, or Firm*—Diederiks & Whitelaw, PLC

(57) ABSTRACT

A refrigerator handle assembly includes a base plate which is initially attached to the face of the refrigerator, such as through the use of screws or the like. The base plate includes tapered surfaces, preferably at longitudinally spaced positions. Once the base plate is secured, a portion of the handle is placed over the base plate and slid relative to the base plate whereupon the tapered surfaces coact with structure on the handle such that an interference fit is developed to draw the handle tight to the face of the door. With the handle in this position, one or more mechanical fasteners are driven into a body portion of the handle from a back side of the door.

20 Claims, 4 Drawing Sheets

REFRIGERATOR HANDLE MOUNTING ARRANGEMENT

BACKGROUND OF THE INVENTION

1. Field of the Invention

The present invention pertains to the art of refrigerators and, more particularly, to a mounting arrangement for a handle on a refrigerator.

2. Discussion of the Prior Art

Conventional handle arrangements for refrigerators are formed from multiple pieces, including a handle frame and a handle piece having a gripping portion. Such a handle is typically mounted to a refrigerator cabinet utilizing screws which extend through the handle piece and frame, clamping the overall handle to a panel of the refrigerator cabinet. Once the handle is in place, a cover is inserted over the screw, with the cover extending only over the area of the screws or along substantially the entire length of the handle. In general, this known handle mounting arrangement is rather hard to assemble and often results in witness lines that take away from the overall aesthetics of the refrigerator.

In certain refrigerators, gas assist handles are employed in an attempt to simplify the construction and assembly, while also improving the aesthetics. Such handle arrangements are also considered advantageous given their characteristic soft feel. Regardless, there still exists a need in the art for an improved refrigerator handle mounting arrangement preferably, but certainly not limited to, mounting a gas assist handle to a refrigerator in a manner which provides a tight, aesthetically appealing and easily assembled overall arrangement.

SUMMARY OF THE INVENTION

The present invention pertains to the mounting of a handle to a door face of a refrigerator. In accordance with the most preferred form of the invention, a base piece is initially attached to the face of the refrigerator, such as through the use of screws or the like. The base piece includes tapered surfaces, preferably at longitudinally spaced positions. Once the base piece is secured, a portion of a handle is placed over the base piece and slid relative to the base whereupon the tapered surfaces coact with structure of the handle such that an interference fit is developed to keep the handle tight to the door panel. With the handle in this position, one or more mechanical fasteners are driven into a body portion of the handle from a back side of the door panel. With this arrangement, all of the mechanical fasteners are hidden and witness lines, corresponding to those associated with conventional handle mounting arrangements, are avoided.

Additional objects, features and advantages of the present invention will be more readily apparent from the following detailed description of preferred embodiments of the invention, when taken in conjunction with the drawings wherein like reference numerals refer to corresponding parts in the several views.

DETAILED DESCRIPTION OF THE PREFERRED EMBODIMENT

Figure 1:
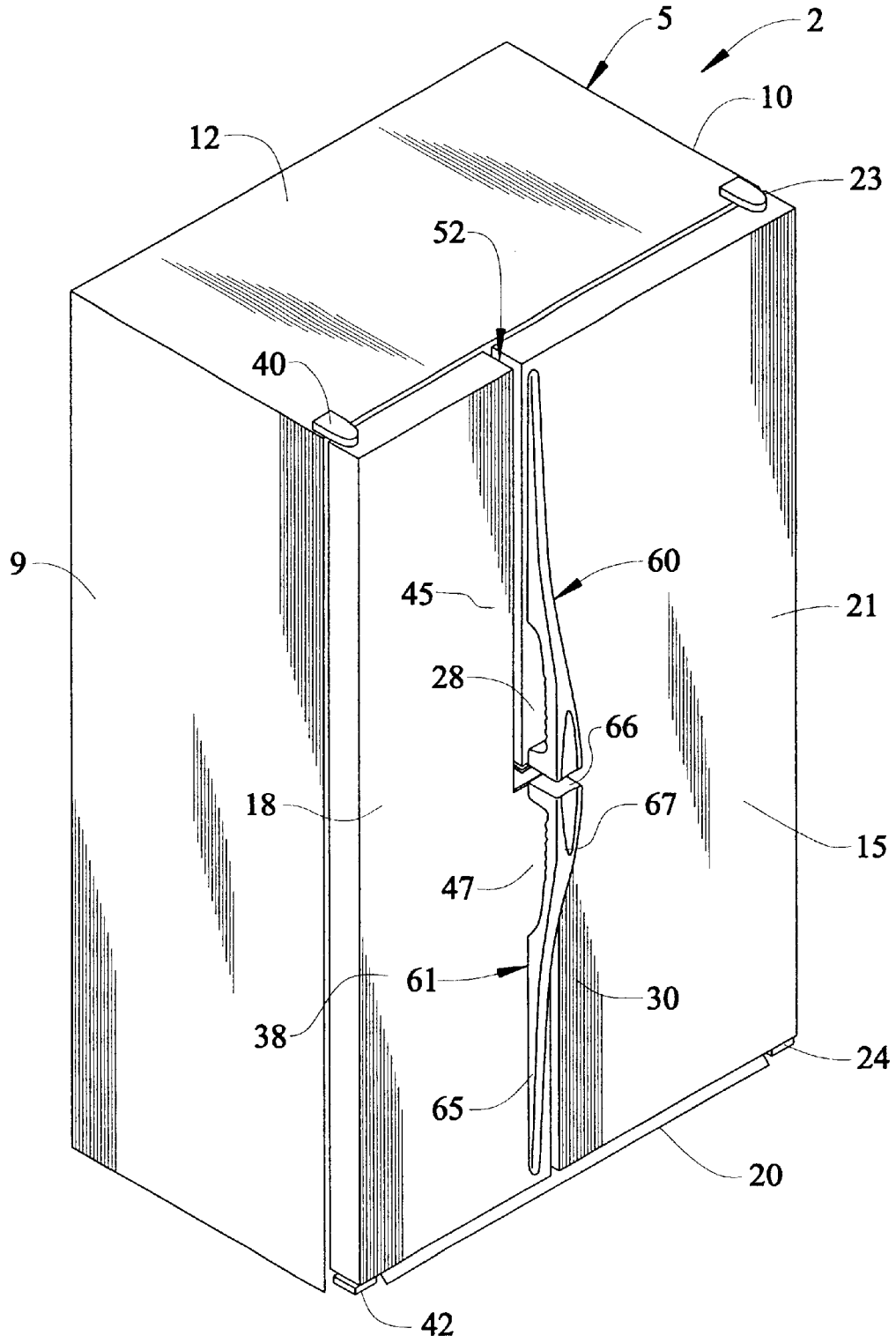
FIG. 1 is upper front perspective view of a refrigerator cabinet incorporating a refrigerator door handle arrangement constructed in accordance with a preferred embodiment of the present invention.
Figure 2:
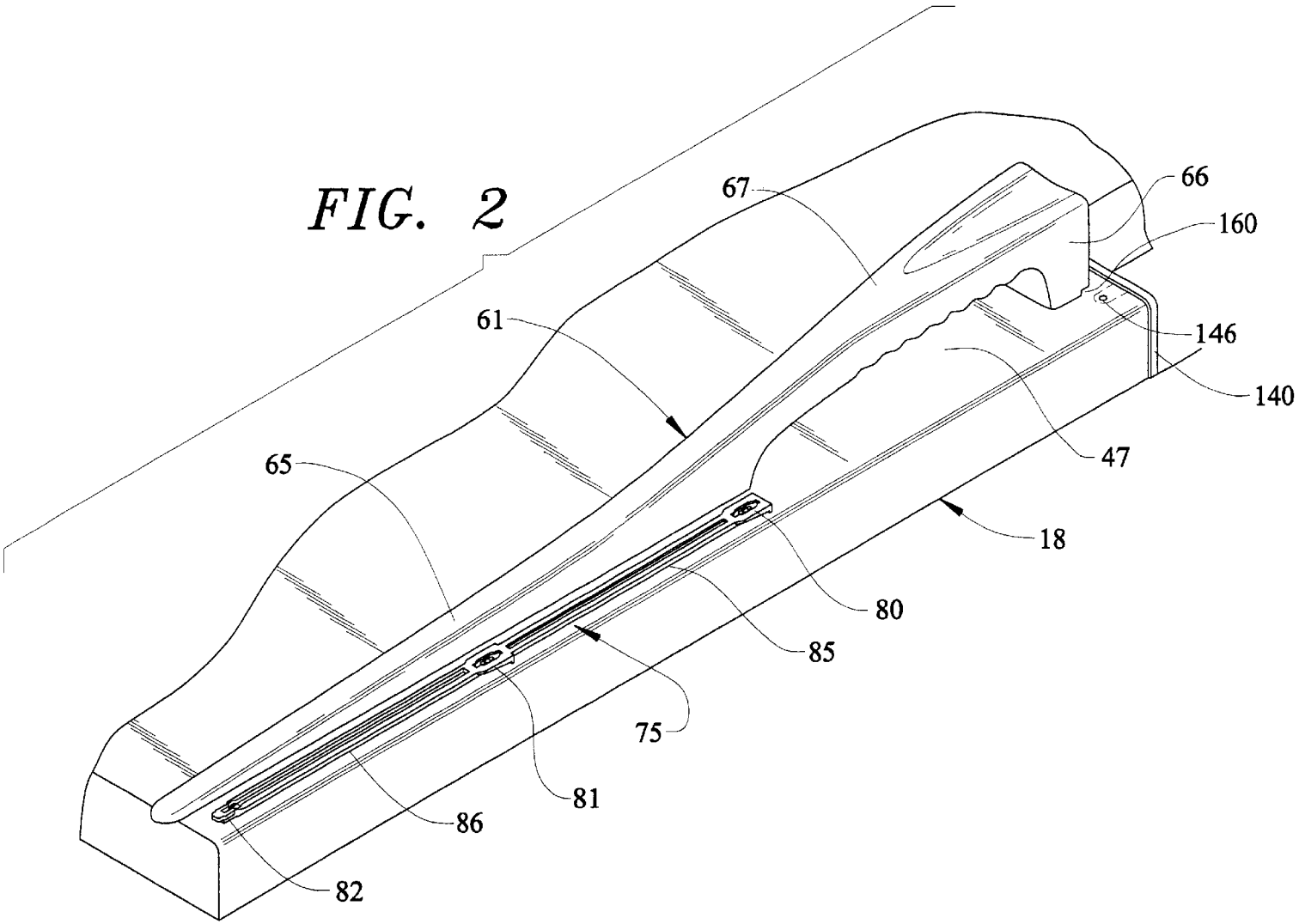
FIG. 2 is a partial exploded view of the handle arrangement of FIG. 1.

With initial reference to FIG. 1, the handle arrangement of the invention is shown mounted to a refrigerator cabinet which is generally indicated at 2. Although the handle arrangement can be applied to various different types and styles of refrigerators, as shown, refrigerator cabinet 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator cabinet 2 constitutes a side-by-side refrigerator having a fresh food compartment door 15 which is arranged laterally juxtaposed a freezer door 18. Extending laterally across cabinet shell 5, below fresh food and freezer doors 15 and 18 is a kickplate 20. Aside from the aspects which will be described more fully below, the basic construction and operation of refrigerator cabinet 2 is known in the art, does not form part of the present invention and therefore will not be discussed further herein.

Fresh food door 15 includes an outer vertical edge portion 21 which is pivotally attached to cabinet shell 5 through upper hinge 23 and a lower hinge 24. In accordance with the present invention, fresh food door 15 includes an upper inner edge portion 28 and an offset lower inner edge portion 30. Therefore, upper and lower inner edge portions 28 and 30 are laterally spaced and extend in vertically offset planes or axes. In a generally similar manner, freezer door 18 includes an outer edge portion 38 which is pivoted at upper hinge 40 and lower hinge 42 for movement relative to cabinet shell 5. In addition, freezer door 18 includes an upper inner edge portion 45 which is offset from a lower inner edge portion 47. Again, the exact construction of refrigerator 2 can vary greatly without departing from the invention.

As opposed to a more conventional side-by-side refrigerator wherein inner edge portions of fresh food and freezer doors would be spaced by a vertical, single axis gap, fresh food and freezer doors 15 and 18 in accordance with refrigerator 2 are spaced in a central zone of refrigerator cabinet 2 by a gap 52 that includes a first vertical component between upper inner edge portions 28 and 45, a lateral component between inner edge portions 28 and 47 and a second vertical component between lower inner edge portions 30 and 47. Therefore, fresh food door 15 is wider in an upper portion thereof than in a lower portion. Correspondingly, freezer door 18 is wider in a lower portion than in an upper portion. As will become more fully evident below, fresh food and freezer doors 15 and 18 conceal fresh food and freezer compartments of refrigerator cabinet 2 which also have varying width upper and lower sections in accordance with the present invention. In any event, further details of this basic structure of refrigerator 2 is provided in U.S. Pat. No. 6,019,447 which is incorporated herein by reference.

The present invention is actually directed to the mounting of handles 60 and 61 for fresh food and freezer doors 15 and 18 respectively. Although the particular handle configuration can vary in accordance with the present invention, it is the particular mounting arrangement for one or more handles, such as handles 60 and 61, to which the present invention is particularly directed. As shown, each handle 60, 61 includes a first, elongated end portion 65, a second end portion 66, and an intermediate portion 67 interconnecting the first and second end portions 65 and 66. At this point, it should be understood that the exact configuration of handles 60 and 61 merely represents a preferred arrangement and various handle designs could be readily employed without departing from the invention.

Reference will now be made to FIGS. 2–5 in describing the preferred mounting of handle 61 in accordance with the present invention and it is to be understood that handle 60 is constructed and mounted in a corresponding manner. With initial reference to FIG. 2, a base plate 75 is initially mounted to lower inner edge portion 47 of freezer door 18. In accordance with the most preferred embodiment of the invention, base plate 75 includes first, second and third spaced mounting sections 80–82 which are joined by elongated connecting sections 85 and 86. First and second mounting sections 80 and 81 are substantially, identically constructed such that the preferred construction of second mounting section 81 will now be described in detail with particular reference to FIG. 3 and is to be understood that corresponding structure exists with respect to first mounting section 80.

Figure 3:
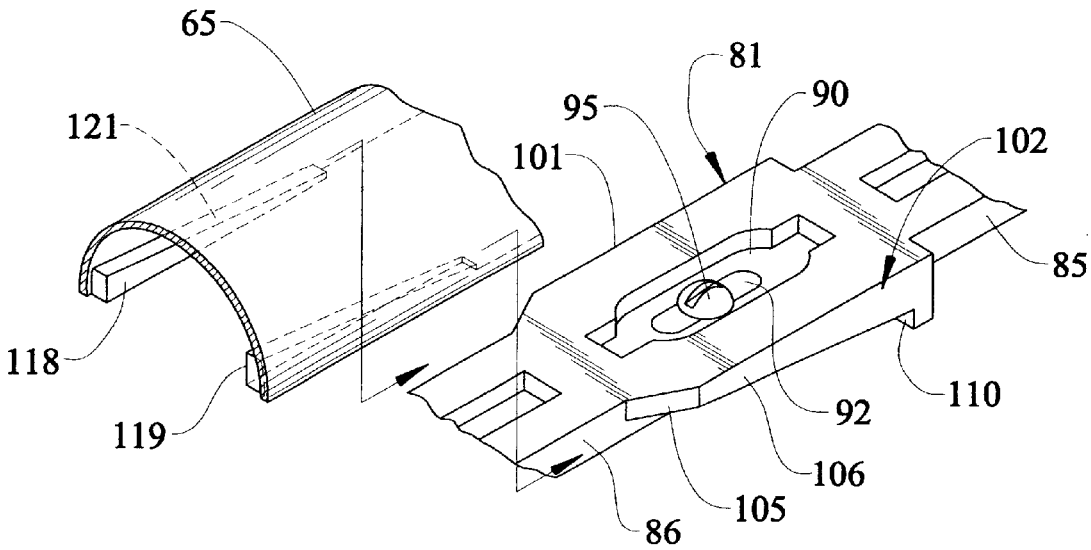
FIG. 3 is an enlarged view of a portion of the mounting structure for the handle arrangement of FIGS. 1 and 2.

As shown in FIG. 3, second mounting section 81 includes a central recessed zone 90 within which is defined an elongated through slot 92. Through slot 92 is adapted to receive a mechanical fastener 95, such as a sheet metal screw, for use in attaching base plate 75 to freezer door 18. Extending beyond the lateral dimensions of connecting sections 85 and 86, second mounting section 81 is provided with side flanges 101 and 102. Each side flange 101, 102 includes a diverging portion 105 leading from connecting section 86, as well as a sidewall portion 106. As clearly shown in this figure in viewing sidewall 106, each side flange 101, 102 preferably tapers from adjacent a downwardly extending wall 110 towards diverging portion 105. With this arrangement, each side flange 101 and 102 defines a tapering undercut for base plate 75 which is adapted to coact with a respective elongated tab portion 118, 119 formed at a predetermined location along first end portion 65 of handle 61. As clearly shown, each elongated tab portion 118, 119 preferably defines a wedge surface 121 which is adapted to coact with a respective side flange 101, 102 as will be detailed more fully below. At this point, it again should be realized that corresponding structure exists for both base plate 75 and second end portion 66 of handle 61 at first mounting section 80.

Figure 4:
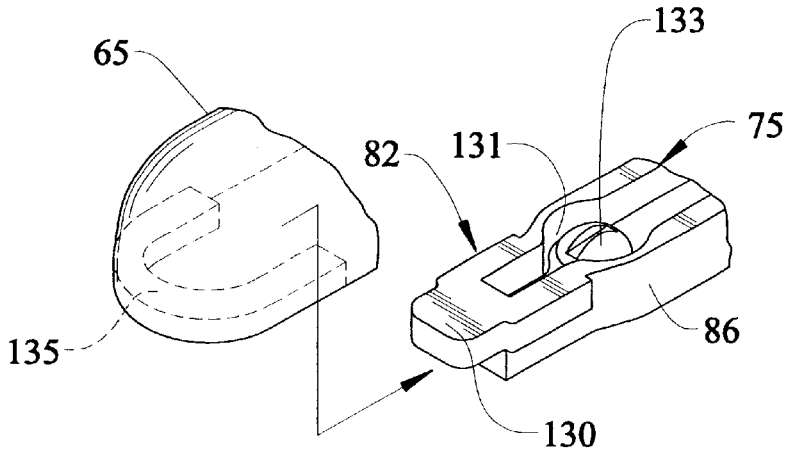
FIG. 4 is an enlarged view of another portion of the mounting structure for the handle arrangement of the invention.

FIG. 4 illustrates the preferred construction of third mounting section 82 and the interaction with first end portion 65. Preferably, base plate 75 terminates in a raised projection 130 that is shown to be rounded. Projection 130 is generally flat and spaced from a recess 131 having a hole (not labeled) therein which is adapted to receive a mechanical fastener such as screw 133 in order to establish another connection location between base plate 75 and freezer door 18. On the other hand, the terminal end of first end portion 65 of handle 61 is provided with an internal, arcuate ledge 135 which is adapted to slip under raised projection 130 upon mounting of handle 61 as will be detailed more fully below.

Figure 5:
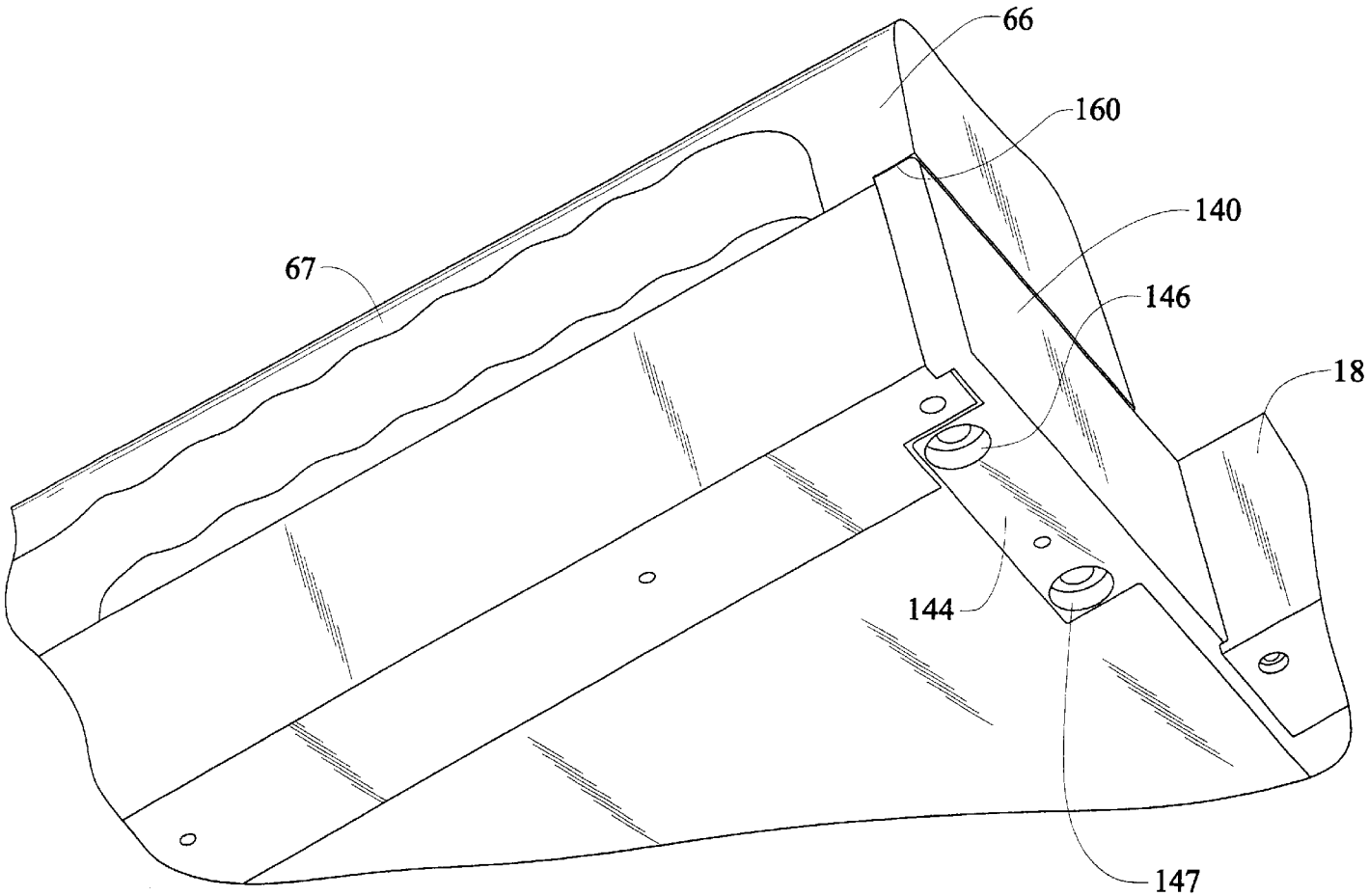
FIG. 5 is a perspective view of an upper rear portion of the refrigerator door illustrating additional mounting structure for the overall handle arrangement.

FIG. 5 illustrates a preferred construction of the rear portion of freezer door 18, prior to attaching an inner door liner thereto. As shown, door 18 preferably includes a molded plastic cap 140 that has a rear, in-turn flange 144 formed with a pair of spaced, countersunk holes 146 and 147. In general, holes 146 and 147 are adapted to receive mechanical fasteners such as screws (not shown) which extend through door 18 and are threadably received within second end portion 66 of handle 61. More specifically, with the mounting arrangement of the present invention, base plate 75 is initially attached to lower edge portion 47 of freezer door 18 by mechanical fasteners as fully described above. In the most preferred embodiment of the invention, base plate 75 is molded of plastic. However, base plate 75 could be formed of metal. After base plate 75 is secured to lower inner edge portion 47, handle 61 is arranged with first end portion 65 extending above base plate 75 such that ledge 135 is spaced from raised projection 130 and second edge portion 66 is spaced from holes 146 and 147 in the manner generally shown in FIG. 2.

In this position, first end portion 65 of handle 61 can be completely laid over base plate 75 so as to extend about and substantially cover base plate 75. Thereafter, the entire handle 61 is shifted or slid relative to base plate 75, whereupon elongated tab portions 118 and 119 slip under side flanges 101 and 102 at each of first and second mounting sections 80 and 81, while internal ledge 135 slips under raised projection 130 at third mounting section 82. Due to the tapering of at least each sidewall 106 of side flanges 101 and 102, as handle 61 is shifted in this manner, handle 61 is drawn against door 18. That is, base plate 75 and handle member 61 include mating surfaces which coact along tapered portions thereof to draw handle 61 to the front side of door 18 upon shifting of handle 61 relative to base plate 75. This interaction can occur simply due to tapering of each sidewall 106 at mounting sections 80 and 81. In addition, a similar tapering could be employed at the interconnection between raised projection 130 and ledge 135 to perform a similar wedging function. In any event, handle 61 is shifted relative to door 18 and base plate 75 until a notch 160 formed in second end portion 66 abuts door cap 140, with the shifting being further limited due to the presence of walls 100, in order to properly align second end portion 66 with holes 146 and 147 to receive respective mechanical fasteners from the backside of door 18. In the most preferred embodiment, base plate 75 actually tapers as clearly shown in referring to at least FIGS. 3 and 4. A similar configuration is preferably provided for elongated first end portion 65 of handle 61. This overall tapering arrangement simply makes it easier to slide handle 61, as discussed above, during the mounting process without causing any potential interference problems.

With this handle mounting arrangement, handle 61 can be advantageously formed of plastic, preferably with a cushioned intermediate section 67 preferably being created through a gas assist operation during molding for gripping purposes, and a tight, aesthetically appealing, as well as easily assembled, overall handle arrangement is defined. In any event, although described with reference to a preferred embodiment of the invention, it should be understood that various changes and/or modifications can be made without departing from the spirit of the invention. Therefore, in general, the invention is only intended to be limited in accordance with scope of the following claims.

What is claimed is:

1. In a refrigerator including a cabinet defining an interior compartment and a door, having front and back sides, pivotally mounted to the cabinet for selectively accessing the compartment, a handle assembly for the door comprising:

a base plate fixed to the door along a portion of the front side;

a handle member including first and second end portions separated by an intermediate portion, said first end portion being slidably mounted over the base plate, said base plate and the first end portion of said handle member including mating surfaces which coact along tapered portions thereof to draw said handle member to the front side of the door upon shifting of the handle member relative to the base plate; and at least one fastener for securing the second end portion of the handle member to the door, with the intermediate portion being spaced from the front side of the door to enable the handle member to be grasped in order to selectively open and close the door.

2. The handle assembly according to claim 1, wherein the base plate includes a pair of spaced mounting sections each of which includes at least one tapered flange defining one of the tapered portions.

3. The handle assembly according to claim 2, wherein each of the space mounting sections further includes a wall which limits the shifting of the handle member relative to the base plate.

4. The handle assembly according to claim 2, wherein each of the mounting sections includes a pair of spaced, tapered flanges.

5. The handle assembly according to claim 2, wherein the base plate includes an additional mounting section provided with a projection, with a portion of the handle member extending under the projection when the handle member is mated with the base plate.

6. The handle assembly according to claim 1, wherein the at least one fastener extends into the second end portion of the handle member from the back side of the door.

7. The handle assembly according to claim 6, further comprising: a cap provided on a portion of the door, said at least one fastener extending through the cap.

8. In a refrigerator including a cabinet defining an interior compartment and a door, having front and back sides, pivotally mounted to the cabinet for selectively accessing the compartment, a handle assembly for the door comprising:

a base plate fixed to the door along a portion of the front side;

a handle member including first and second end portions separated by an intermediate portion, said first end portion being slidably mounted over the base plate;

tapered means coacting between said base plate and the first end portion of said handle member or drawing said handle member to the front side of the door upon shifting of the handle member relative to the base plate; and at least one fastener for securing the second end portion of the handle member to the door, with the intermediate portion being spaced from the front side of the door to enable the handle member to be grasped in order to selectively open and close the door.

9. The handle assembly according to claim 8, wherein the base plate includes a pair of spaced mounting sections, said tapered means including at least one tapered flange provided on each of the spaced mounting sections.

10. The handle assembly according to claim 9, wherein each of the space mounting sections further includes a wall which limits the shifting of the handle member relative to the base plate.

11. The handle assembly according to claim 9, wherein the tapered means comprises a pair of spaced tapered flanges provided on each of the mounting sections.

12. The handle assembly according to claim 9, wherein the base plate includes an additional mounting section provided with a projection, with a portion of the handle member extending under the projection when the handle member is mated with the base plate.

13. The handle assembly according to claim 8, wherein the at least one fastener extends into the second end portion of the handle member from the back side of the door.

14. The handle assembly according to claim 13, further comprising: a cap provided on a portion of the door, said at least one fastener extending through the cap.

15. A method of attaching a handle assembly to a door, having front and back sides, of a refrigerator comprising:

fixedly securing a base plate along a portion of the front side of the door;

slidably interconnecting a first end portion of a handle member to the base plate while simultaneously drawing the handle member to the front side of the door; and mechanically fastening a second end portion of the handle member to the door, with an intermediate portion of the handle member being spaced from the front side of the door to enable the handle to be grasped in order to selectively open and close the door.

16. The method according to claim 15, wherein the handle member interacts with the base plate along tapering surfaces to draw the handle member to the front side of the door upon slidably interconnecting the first end portion of the handle member to the base plate.

17. The method according to claim 16, wherein the handle member interacts with at least two sets of tapering surfaces provided on the base plate.

18. The method according to claim 15, further comprising: limiting the permissible relative sliding movement between the handle member and the base plate by engaging a portion of the handle member with a wall portion of the base plate.

19. The method according to claim 15, wherein the second end portion of the handle member is mechanically fastened to the door with at least one fastener which extends into the second end portion from a back side of the door.

20. The method according to claim 19, wherein the at least one fastener extends through the door prior to mounting a liner to the door.

* * * * *